US007240377B2

(12) United States Patent
Vanden Heuvel

(10) Patent No.: US 7,240,377 B2
(45) Date of Patent: Jul. 10, 2007

(54) DUAL MODE SEAT SYSTEM

(76) Inventor: Robert Jerome Vanden Heuvel, 1224 Fairview Ct., Little Chute, WI (US) 54140

( * ) Notice: Subject to any disclaimer, the term of this patent is extended or adjusted under 35 U.S.C. 154(b) by 340 days.

(21) Appl. No.: 10/874,875

(22) Filed: Jun. 23, 2004

(65) Prior Publication Data

US 2005/0283886 A1 Dec. 29, 2005

(51) Int. Cl.
*A47K 13/28* (2006.01)

(52) U.S. Cl. ..... 4/237; 4/254

(58) Field of Classification Search ..... 4/235–237, 4/239, 240, 254, 450, 457; 297/311
See application file for complete search history.

(56) References Cited

U.S. PATENT DOCUMENTS

| | | | | |
|---|---|---|---|---|
| 849,423 | A | 4/1907 | Ort | 4/239 |
| 2,554,422 | A | 5/1951 | Richards et al. | 4/239 |
| 2,584,141 | A | 2/1952 | Liebling | 4/234 |
| 2,713,688 | A * | 7/1955 | Johnson | 4/237 |
| 4,466,140 | A | 8/1984 | Sakamoto | 4/254 |
| 4,964,179 | A | 10/1990 | Kimes | 4/239 |
| 4,977,628 | A * | 12/1990 | Barrett | 4/237 |
| 5,141,354 | A | 8/1992 | Morsbach | 4/239 X |
| 5,189,739 | A | 3/1993 | Thierry | 4/254 |
| 5,267,357 | A | 12/1993 | Ades | 4/240 X |
| 5,608,921 | A | 3/1997 | Barrett et al. | 4/239 |
| 5,737,780 | A | 4/1998 | Okita et al. | 4/254 X |
| 6,154,896 | A | 12/2000 | Houston et al. | 4/667 |
| 6,418,566 | B1 | 7/2002 | Plonta | 4/239 |
| 6,553,585 | B1 | 4/2003 | Lundstrom | 4/667 |

FOREIGN PATENT DOCUMENTS

| | | |
|---|---|---|
| DE | 199 48 296 A1 | 4/2001 |
| WO | WO 97/41765 | 11/1997 |

* cited by examiner

*Primary Examiner*—Robert M. Fetsuga

(57) ABSTRACT

The invention concerns a dual mode seat system for a toilet. The seat system includes a toilet seat, a hinge, and a support. The hinge is joined with a seat back end and can also join with the toilet there. The supports is joined to a seat front end and is located between the toilet seat and the toilet when the toilet seat is positioned overlying the toilet. The hinge and the support together (a) cooperate to maintain the toilet seat in a low mode which provides a low spacing between the toilet seat and the toilet, and alternatively, (b) cooperate to maintain the toilet seat in a high mode which provides a high spacing between the toilet seat and the toilet, and in both modes with the toilet seat in a substantially horizontal orientation and where the high spacing is greater than the low spacing.

21 Claims, 4 Drawing Sheets

DUAL MODE SEAT SYSTEM

BACKGROUND OF THE INVENTION

Generally, the invention relates to a toilet seat for use with existing and/or conventional toilets to assist special need users of the toilet. Existing such devices are either complicated and difficult to use, or if not so complicated, then they do not have the flexibility to serve both special need users and non-special needs users of the toilet. Consequently, a new toilet seat system is needed which will assist in easily and alternatively providing a toilet seat that serves both conventional users and those with special toileting needs.

SUMMARY OF THE INVENTION

The present invention is directed to avoiding at least the just discussed shortcomings. More particularly, the invention concerns a dual mode seat system for a toilet having a toilet front portion and a toilet back portion. The seat system includes a toilet seat, a hinge and a support. The toilet seat has a seat front end and a seat back end. The hinge has a hinge front end and a hinge back end. The hinge front end is joined with the toilet seat proximate the seat back end and the hinge back end is joinable with the toilet proximate the toilet back portion. The support is joined to the toilet seat proximate the seat front end and projecting away from the toilet seat such that the support is located between the toilet seat and the toilet proximate the toilet front portion when the toilet seat is positioned overlying the toilet. The hinge and the support together: (a) cooperate to maintain the toilet seat in a low mode which provides a low spacing between the toilet seat and the toilet and with the toilet seat in a substantially horizontal orientation, and alternatively, (b) cooperate to maintain the toilet seat in a high mode which provides a high spacing between the toilet seat and the toilet and with the toilet seat in the substantially horizontal orientation. The high spacing is greater than the low spacing. As taught herein, the versatility, simplicity and/or durability of the new dual mode seat system may further advantage it over any prior device. All this can be accomplished, for example, with some or all of the features of the present dual mode seat system.

The invention also concerns optional features for a dual mode seat system for a toilet having a toilet front portion and a toilet back portion. The seat system includes a toilet seat, a hinge and a support. The toilet seat has a seat front end and a seat back end. The hinge has a hinge front end and a hinge back end. The hinge front end is joined with the toilet seat proximate the seat back end and the hinge back end is joined with the toilet proximate the toilet back portion. The support is joined to the toilet seat proximate the seat front end and projecting away from the toilet seat such that the support is located between the toilet seat and the toilet proximate the toilet front portion when the toilet seat is positioned overlying the toilet. The hinge and the support together: (a) cooperate to maintain the toilet seat in a low mode which provides a low spacing between the toilet seat and the toilet and with the toilet seat in a substantially horizontal orientation, and alternatively, (b) cooperate to maintain the toilet seat in a high mode which provides a high spacing between the toilet seat and the toilet and with the toilet seat in the substantially horizontal orientation. The high spacing is greater than the low spacing. At least a portion of the seat front end projects forward of all of the toilet front portion when the seat system is in the low mode and a front most edge of the seat front end does not project forward of a front most edge of the toilet front portion when the seat system is in the high mode.

The invention further concerns other optional features for a dual mode seat system for a toilet having a toilet front portion and a toilet back portion. The seat system includes a toilet seat, a hinge and a support. The toilet seat has a seat front end and a seat back end. The hinge has a hinge front end and a hinge back end. The hinge front end is joined with the toilet seat proximate the seat back end and the hinge back end is joined with the toilet proximate the toilet back portion. The support is joined to the toilet seat proximate the seat front end and projecting away from the toilet seat such that the support is located between the toilet seat and the toilet proximate the toilet front portion when the toilet seat is positioned overlying the toilet. The hinge and the support together: (a) cooperate to maintain the toilet seat in a low mode which provides a low spacing between the toilet seat and the toilet and with the toilet seat in a substantially horizontal orientation, and alternatively, (b) cooperate to maintain the toilet seat in a high mode which provides a high spacing between the toilet seat and the toilet and with the toilet seat in the substantially horizontal orientation. The high spacing is greater than the low spacing. The support and the hinge are configured to cooperate to temporarily lock the toilet seat in the low mode and alternatively the high mode, and an inner circumference of the toilet seat is always positioned within an inner circumference of an inner rim of the toilet.

Still further, the invention concerns various optional configurations of the toilet seat, the hinge and the support.

These and other features and functions of the present invention will be explained and understood upon reviewing the following detailed description and with reference to the accompanying drawings.

DETAILED DESCRIPTION OF THE INVENTION

Figure 1:
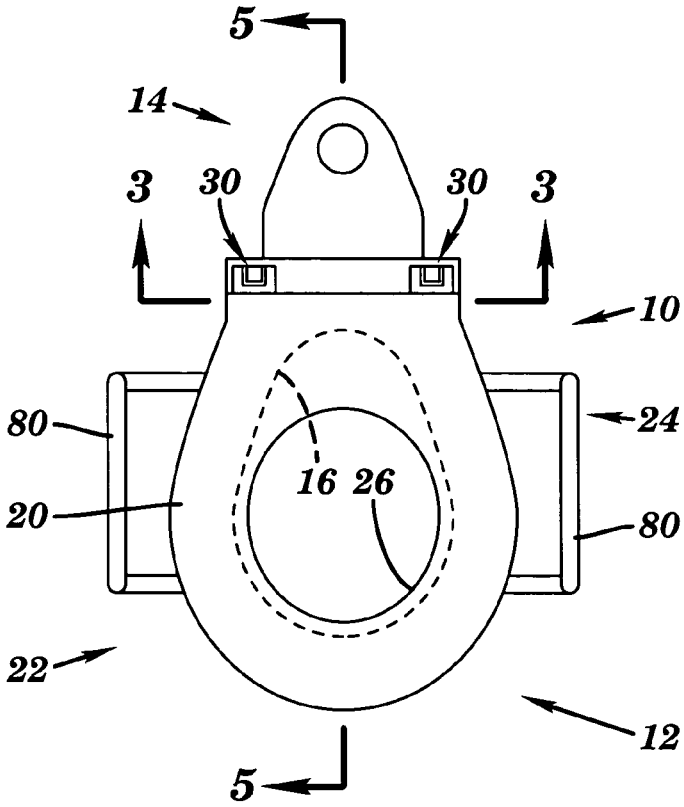
FIG. 1 is a top view of the invention in a low mode.
Figure 2:
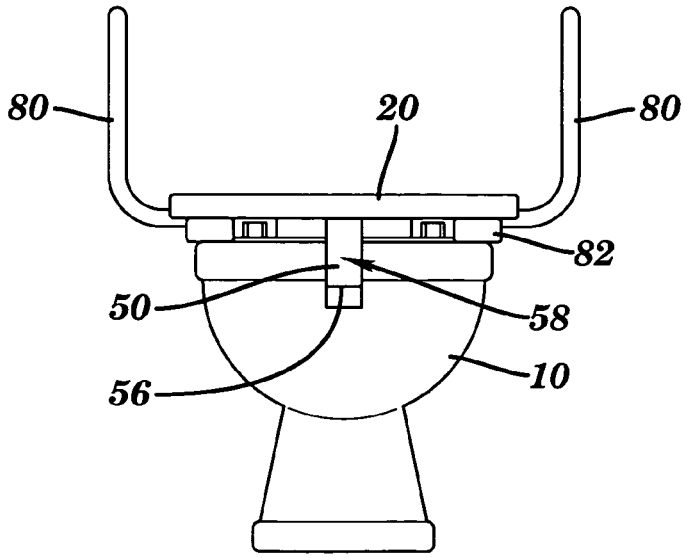
FIG. 2 is a front view of the invention seen in FIG. 1.
Figure 6:
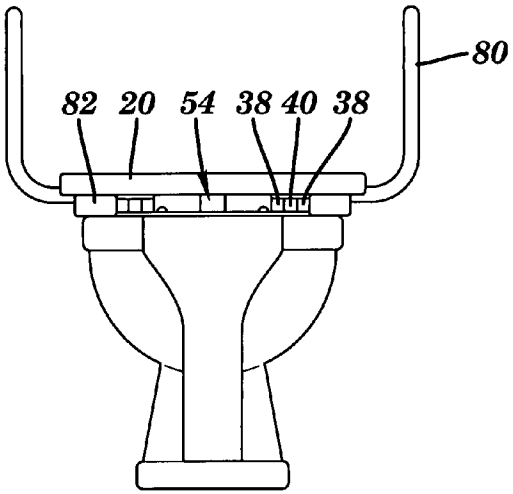
FIG. 6 is a back view of the invention seen in FIG. 1.
Figure 4:
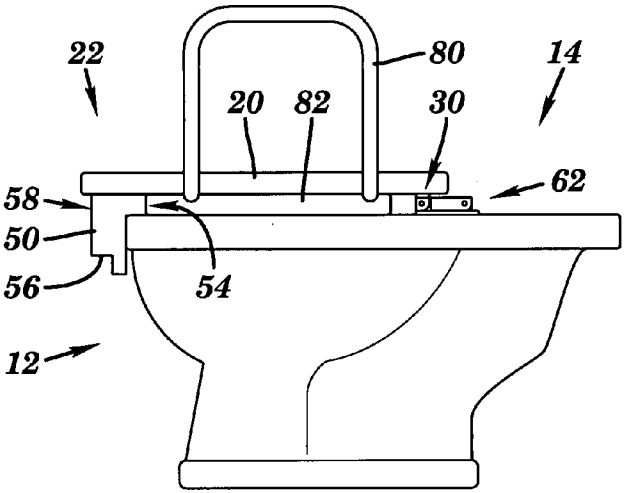
FIG. 4 is a side view of the invention seen in FIG. 1, where the opposite side view is a mirror image thereof.

Referring to the Figures in general, there is seen a dual mode seat system for a toilet 10. The seat system includes a toilet seat 20, a hinge which includes one or more hinge unit 30, and a support 50. More particularly, and for example referring to FIGS. 1 and 4, the toilet 10 has a toilet front portion 12 and a toilet back portion 14. The toilet seat 20 has a seat front end 22 and a seat back end 24. The toilet seat may be of a variety of shapes, for example, a continuous donut shape (as shown), U-shaped (not shown), or other existing toilet seat configurations (not shown). A donut shaped configuration may be advantageous for simplicity and other desired features of the invention, but such is not required.

Figure 5:
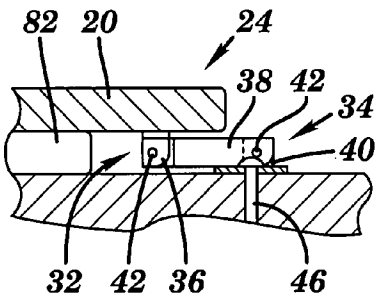
FIG. 5 is a cross-sectional view of a portion of the invention seen in FIG. 1, taken along the line 5-5.
Figure 7:
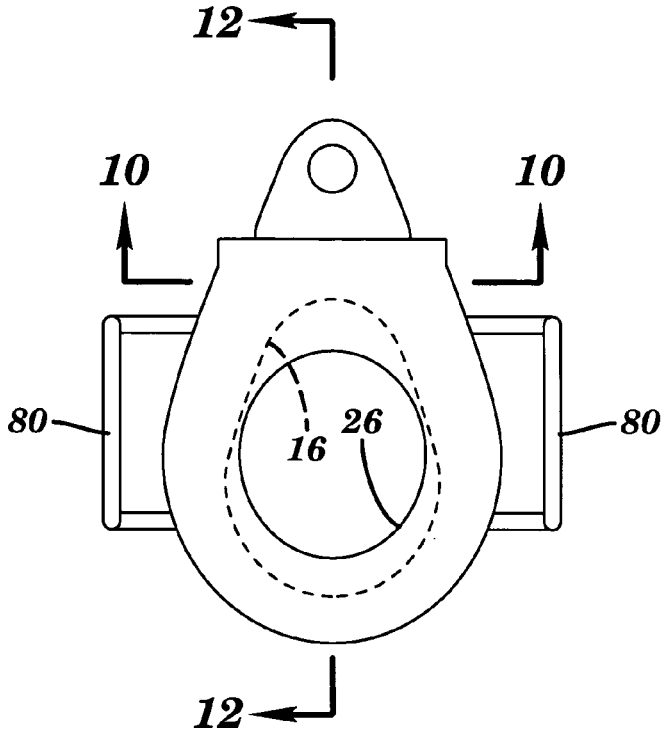
FIG. 7 is a top view of the invention in a high mode.
Figure 8:
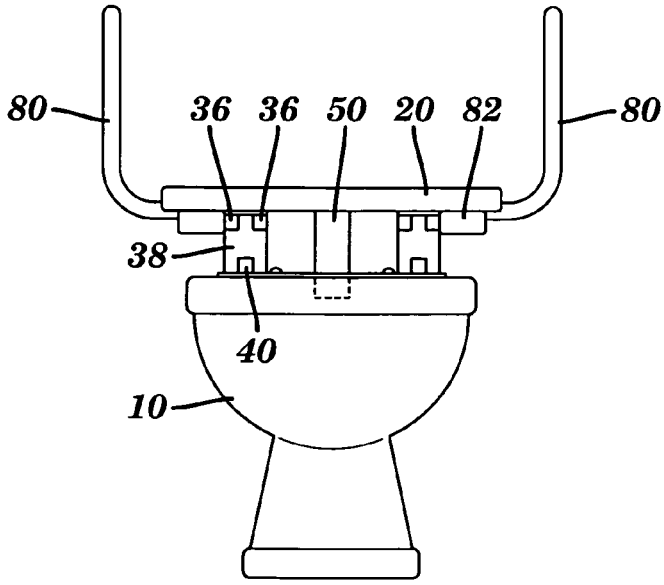
FIG. 8 is a front view of the invention seen in FIG. 7.
Figure 9:
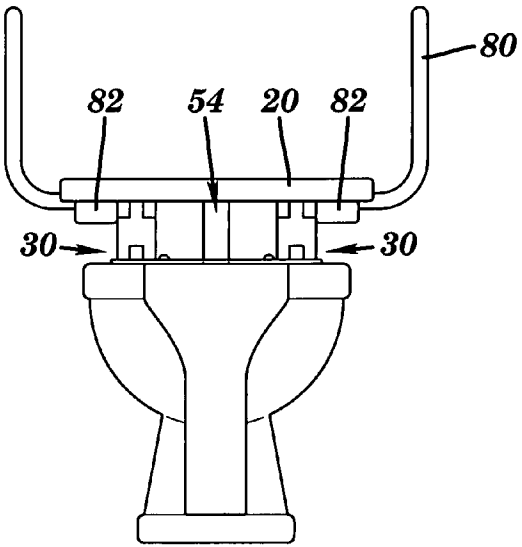
FIG. 9 is a back view of the invention seen in FIG. 7.

Also referring to FIG. 5, hinge unit 30 has a hinge front end 32 and a hinge back end 34. Hinge front end 32 is joined with the toilet seat 20 proximate the seat back end 24, for example, by way of mounting screws (not shown), adhesive, bonding, or other mechanical fastening mechanism(s) that can achieve the same result. The hinge back end 34 is joinable with the toilet 10 proximate the toilet back portion 14. For example, this may be accomplished by the hinge back end 34 being joined to a mounting plate 44, and the mounting plate in turn being joinable to the toilet back end (and when so joined being securely joined to the toilet) by way of mounting bolt(s) 46 (and corresponding nut(s), not shown), adhesive, bonding, or other mechanical fastening mechanism(s) that can achieve the same result.

The support 50 is joined to the toilet seat 20 proximate the seat front end 22, for example, by way of mounting screws (not shown), adhesive, bonding, or other mechanical fastening mechanism(s) that can achieve the same result. Support 50 projects away from the toilet seat such that the support is located between the toilet seat 20 and the toilet 10 proximate the toilet front portion 12 when the toilet seat is positioned overlying the toilet.

Figure 3:
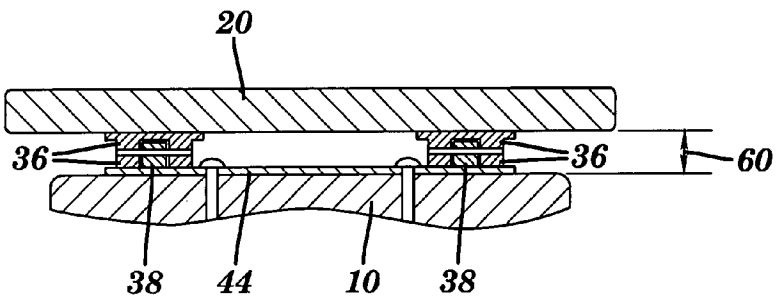
FIG. 3 is a cross-sectional view of a portion of the invention seen in FIG. 1, taken along the line 3-3.
Figure 10:
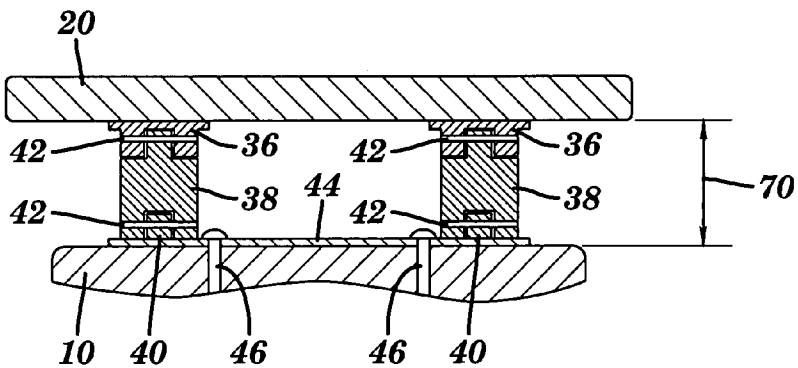
FIG. 10 is a cross-sectional view of a portion of the invention seen in FIG. 7, taken along the line 10-10.
Figure 11:
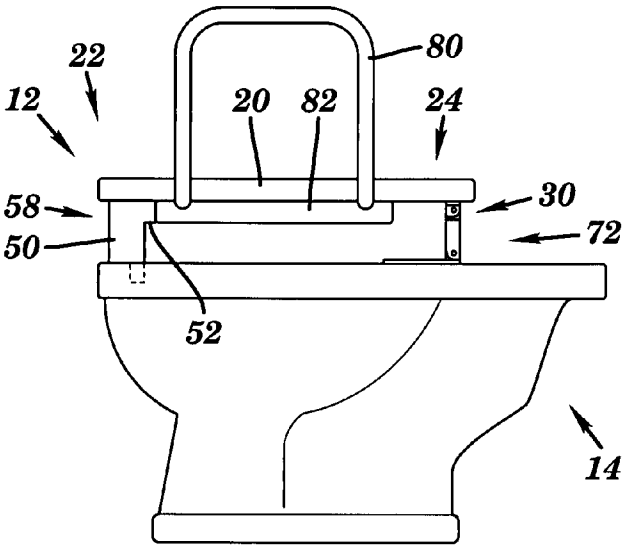
FIG. 11 is a side view of the invention seen in FIG. 7, where the opposite side view is a mirror image thereof.
Figure 12:
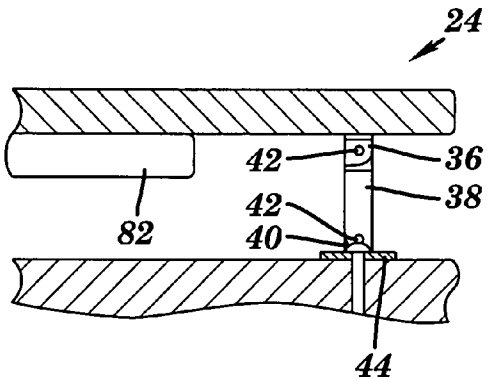
FIG. 12 is a cross-sectional view of a portion of the invention seen in FIG. 7, taken along the line 12-12.

The hinge and the support together provide dual mode positioning of the toilet seat when the system is operated between a low mode (i.e., FIGS. 1-6) and a high mode (i.e., FIGS. 7-12) by a user (not shown). The hinge and the support together cooperate to maintain the toilet seat in the low mode which provides a low spacing 60 (FIG. 3) between the toilet seat 20 and the toilet 10, and with the toilet seat in a substantially horizontal orientation (the horizontal orientation here seen throughout FIGS. 1-6, but best seen in FIG. 4). Alternatively, the hinge and the support together cooperate to maintain the toilet seat in the high mode which provides a high spacing 70 (FIG. 10) between the toilet seat 20 and the toilet 10, and with the toilet seat in the substantially horizontal orientation (the horizontal orientation here seen throughout FIGS. 7-12, but best seen in FIG. 11). Best seen comparing FIGS. 3 and 10, the high spacing 70 is greater than the low spacing 60.

The invention may also include a variety of other features that may be advantageous, but not necessarily required, for practicing the invention. For example, and referring to FIGS. 3, 5, 10 and 12 as well, the hinge may, advantageously, include two hinge units 30. If such is the case, advantageously each hinge unit is functionally identical to the other hinge unit and each is spaced apart from the other (e.g., as seen throughout the Figures). Also advantageously, the hinge has two pivot points. For example, this may be accomplished by the hinge including three parts pivotally linked together sequentially and with only end parts being joinable to the toilet seat and the toilet, respectively. Such may include front end part 36 pivotally joined with middle end part 38 by a connecting pin 42 at one end of the middle part 38, and, an opposite end of middle part 38 pivotally joined with back end part 40 by a different connecting pin 42.

If the hinge advantageously has two pivot points, each pivot point further advantageously rotates angularly in a direction opposite the other pivot point when the hinge operates between the low mode and the high mode. For example, as the user operates the toilet seat to move it from the low mode to the high mode (i.e., from FIG. 5 positioning to FIG. 12 positioning) by lifting the toilet seat and pushing it toward toilet back portion 14, hinge front end part 36 rotates counterclockwise relative to middle part 38 while hinge back end part 40 rotates clockwise relative to middle part 38 (and vice versa for these respective parts when going from the high mode to the low mode).

As other possible features, and referring to FIGS. 2, 4, 8 and 11 as well, the support may, advantageously, be a single post. If the support is a post, advantageously the post includes a low mode ridge 52 on an inside surface 54 of the support and a high mode ridge 56 on an outside surface 58 of the support. Additionally, the support and the hinge may be configured to cooperate to temporarily lock the toilet seat in the low mode, and alternatively, the high mode, as desired by the user. For example, and without being limited to a theory of understanding, this may be achieved by: (i) the hinge operating throughout a range of movement between the low mode and the high mode whereby when in the low mode the hinge is in an elongate horizontal orientation 62 and when in the high mode the hinge is in an elongate vertical orientation 72, coupled with, (ii) the support including the low mode ridge 52 and the high mode ridge 56. More particularly, the toilet seat is locked into the low mode due to the combination of the low mode ridge 52 resting on the toilet and the support preventing further horizontal movement toward the toilet back portion 14 while the hinge is in the elongate horizontal orientation 62 which prevents further horizontal movement of the toilet seat toward the toilet front portion 12. Conversely, the toilet seat is locked into the high mode due to the combination of the high mode ridge 56 resting on the toilet and the support preventing further horizontal movement toward the toilet front portion 12 while the hinge is in the elongate vertical orientation 72 which prevents further horizontal movement of the toilet seat toward the toilet back portion 14.

Still other possible features, and referring to FIGS. 1, 4, 7 and 11 as well, are directed to making the seat system as normal as possible for both conventional users and those with special toileting needs. In this regard, one way to accomplish this is where at least a portion of the seat front end projects forward of al of the toilet front portion when the seat system is in the low mode, but desirably not too much so. Advantageously complementing this feature, is where a front most edge of the seat front end does not project forward of a front most edge of the toilet front portion when the seat system is in the high mode. Alternatively, or additionally, another way to accomplish this is where an inner circumference 26 of the toilet seat is always positioned within an inner circumference 16 of an inner rim of the toilet, i.e., when in the low mode, and alternatively, when in the high mode. Still alternatively, or additionally, the seat front end can rotate between zero degrees and ninety degrees relative to a horizontal plane when the toilet seat is at or between the low mode, and alternatively, the high mode.

Other possible features the invention may include are where the toilet seat includes at least one handle 80 joined therewith. For example, the handle(s) 80 may project from a side of the toilet seat. This may be accomplished, for example, by sandwiching handle(s) 80 between the toilet seat and a handle connecting block(s) 82, by way of mounting screws (not shown), adhesive, bonding, or other mechanical fastening mechanism(s) that can achieve the same result.

The seat system may be made of various materials. Such materials advantageously have a rigid characteristic so as to be able to endure user seated forces and meet the rotational requirements for the hinge, as these will be subjected to such during the seat system's intended lifetime. For example, these may be metals, plastics and substitutes therefor as would be known to those of skill in the art, and such things as steel, galvanized steel, molded plastics and wood may be employed. The toilet, toilet seat, hinge and support, and their variety of features, may be made to various sizes as long as the relative relationships between certain components, as discussed above, are maintained as desired. Otherwise, generally, the size of the various parts for which the toilet seat is intended and the desired attributes of the seat system, will dictate the overall size of the parts and their components, as would be known to one of ordinary skill in the art in combination with the teachings herein.

While the invention has been described in connection with various features and advantages, such is not intended to limit the scope of the invention to the particular form set forth, but, on the contrary, the invention is intended to cover such alternatives, modifications and equivalents as may be defined by the scope of the following claims.

What is claimed is:

1. A dual mode seat system for a toilet having a toilet front portion and a toilet back portion, comprising:

a toilet seat having a seat front end and a seat back end;

a hinge having a hinge front end and a hinge back end, wherein the hinge front end is joined with the toilet seat proximate the seat back end and the hinge back end is joinable with the toilet proximate the toilet back portion;

a support joined to the toilet seat proximate the seat front end and projecting away from the toilet seat such that the support is located between the toilet seat and the toilet proximate the toilet front portion when the toilet seat is positioned overlying the toilet wherein the support comprises a post and the post includes a low mode ridge on an inside surface and a high mode ridge on an outside surface; and, wherein the hinge moves the toilet seat in a direction towards, and alternately, away from the toilet back portion and the hinge and the support together:

(a) cooperate to maintain the toilet seat in a low mode which provides a low spacing between the toilet seat and the toilet and with the toilet seat in a substantially horizontal orientation, and alternatively, (b) cooperate to maintain the toilet seat in a high mode which provides a high spacing between the toilet seat and the toilet and with the toilet seat in the substantially horizontal orientation, and wherein the high spacing is greater than the low spacing.

2. A dual mode seat system for a toilet having a toilet front portion and a toilet back portion, comprising:

a toilet seat having a seat front end and a seat back end;

a hinge having a hinge front end and a hinge back end, wherein the hinge front end is joined with the toilet seat proximate the seat back end and the hinge hack end is joinable with the toilet proximate the toilet back portion;

a support joined to the toilet seat proximate the seat front end and projecting away from the toilet seat such that the support is located between the toilet seat and the toilet proximate the toilet front portion when the toilet seat is positioned overlying the toilet wherein the support comprises a post and the post includes a low mode ridge on an inside surface and a high mode ridge on an outside surface;

wherein the hinge moves the toilet seat in a direction towards, and alternately, away from the toilet back portion and the hinge and the support together:

(a) cooperate to maintain the toilet seat in a low mode which provides a low spacing between the toilet seat and the toilet and with the toilet seat in a substantially horizontal orientation, and alternatively, (b) cooperate to maintain the toilet seat in a high mode which provides a high spacing between the toilet seat and the toilet and with the toilet seat in the substantially horizontal orientation, and wherein the high spacing is greater than the low spacing; and, wherein the seat front end can rotate between zero degrees and ninety degrees relative to a horizontal plane when the toilet seat is at or between the low mode, and alternatively, the high mode.

3. A dual mode seat system portion, comprising:

a toilet having a toilet front portion and a toilet back portion;

a toilet seat having a seat front end and a seat back end;

a hinge having a hinge front end and a hinge back end, wherein the hinge front end is joined with the toilet seat proximate the seat back end and the hinge back end is joined with the toilet proximate the toilet back portion;

a support located in between sides of the toilet seat and joined to the toilet seat proximate the seat front end and projecting away from the toilet seat such that the support is located between the toilet seat and the toilet proximate the toilet front portion when the toilet seat is positioned overlying the toilet; and, wherein the hinge moves the toilet seat in a direction towards, and alternately, away from the toilet back portion and the hinge and the support together: and (a) cooperate to maintain the toilet seat in a low mode which provides a low spacing between the toilet seat and the toilet and with the toilet seat in a substantially horizontal orientation, and alternatively, (b) cooperate to maintain the toilet seat in a high mode which provides a high spacing between the toilet seat and the toilet and with the toilet seat in the substantially horizontal orientation, and wherein the high spacing is greater than the low spacing.

4. The dual mode seat system of claim 1 wherein the hinge has two pivot points and each pivot point rotates angularly in a direction opposite the other pivot point when the hinge operates between the low mode and the high mode.

5. The dual mode seat system of claim 1 wherein the hinge operates throughout a range of movement between the low mode and the high mode whereby when in the low mode the hinge is in an elongate horizontal orientation and when in the high mode the hinge is in an elongate vertical orientation.

6. The dual mode seat system of claim 1 wherein the hinge comprises two hinge units, with each hinge unit being functionally identical to the other hinge unit, and each hinge unit spaced apart from the other hinge unit.

7. The dual mode seat system of claim 1 wherein the hinge comprises three parts pivotally linked together sequentially and with only end parts being joined to the toilet seat and the toilet, respectively.

8. The dual mode seat system a claim 1 wherein the support and the hinge are configured to cooperate to temporarily lock the toilet seat in the low mode and alternatively the high mode.

9. The dual mode seat system of claim 1 wherein the toilet, seat forms a continuous donut shape.

10. The dual mode seat system of claim 1 wherein at least a portion of the seat front end projects forward of all of the toilet front portion when the seat system is in the low mode.

11. The dual mode seat system of claim 1 wherein a front most edge of the seat front end does not project forward of a front most edge of the toilet front portion when the seat system is in the high mode.

12. The dual mode seat system of claim 1 wherein the toilet seat includes at least one handle joined therewith which projects from a side of the toilet seat.

13. The dual mode seat system of claim 1 wherein an inner circumference of the toilet seat is always positioned within an inner circumference of an inner rim of the toilet.

14. A dual mode seat system comprising:

a toilet having a toilet front portion and a toilet back portion;

a toilet seat having a seat front end and a seat back end;

a hinge having a hinge front end and a hinge back end, wherein the hinge front end is joined with the toilet seat proximate the seat back end and the hinge back end is joined with the toilet proximate the toilet back portion;

a support joined to the toilet seat proximate the seat front end and projecting away from the toilet seat such that the support is located between the toilet seat and the toilet proximate the toilet front portion when the toilet seat is positioned overlying the toilet;

wherein the hinge moves the toilet seat in a direction towards, and alternately, away from the toilet back portion and the hinge and the support together:

(a) cooperate to maintain the toilet seat in a low mode which provides a low spacing between the toilet seat and the toilet and with the toilet seat in a substantially horizontal orientation, and alternatively, (b) cooperate to maintain the toilet seat in a high mode which provides a high spacing between the toilet seat and the toilet and with the toilet seat in the substantially horizontal orientation, and wherein the high spacing is greater than the low spacing; and, wherein at least a portion of the seat front end projects forward of all of the toilet front portion when the seat system is in the low mode and a front most edge of the seat front end does not project toward of a front most edge of the toilet front portion when the seat system is in the high mode.

15. The dual mode seat system of claim 14 wherein the hinge operates throughout a range of movement between the low mode and the high mode whereby when in the low mode the hinge is in an elongate horizontal orientation and when in the high mode the hinge is in an elongate vertical orientation.

16. The dual mode seat system of claim 14 wherein the support comprises a post, and the post includes a low mode ridge on an inside surface and a high mode ridge on an outside surface.

17. The dual mode seat system of claim 14 wherein an inner circumference of the toilet seat is always positioned within an inner circumference of an inner rim of the toilet.

18. A dual mode seat system for a toilet having a toilet front portion and a toilet back portion, comprising:

a toilet seat having a seat front end and a seat back end;

a hinge having a hinge front end and a hinge back end, wherein the hinge front end is joined with the toilet seat proximate the seat back end and the hinge back end can be joined with the toilet proximate the toilet back portion;

a support joined to the toilet seat proximate the seat front end and projecting away from the toilet seat such that the support is located between the toilet seat and the toilet proximate the toilet front portion when the toilet seat is positioned overlying the toilet;

wherein the hinge moves the toilet seat in a direction towards, and alternately, away from the toilet back portion and the hinge and the support together:

(a) cooperate to maintain the toilet seat in a low mode which provides a low spacing between the toilet seat and the toilet and with the toilet seat in a substantially horizontal orientation, and alternatively, (b) cooperate to maintain the toilet seat in a high mode which provides a high spacing between the toilet seat and the toilet and with the toilet seat in the substantially horizontal orientation, and wherein the high spacing is greater than the low spacing; and, wherein the support and the hinge are configured to cooperate to temporarily lock the toilet seat in the low mode and alternatively the high mode, and an inner circumference of the toilet seat is always positioned within an inner circumference of an inner rim of the toilet when the toilet seat is positioned overlying the toilet.

19. The dual mode seat system of claim 18 wherein the hinge operates throughout a range of movement between the low mode and the high mode whereby when in the low mode the hinge is in an elongate horizontal orientation and when in the high mode the hinge is in an elongate vertical orientation.

20. The dual mode seat system of claim 18 wherein the support comprises a post, and the post includes a low mode ridge on an inside surface and a high mode ridge on an outside surface.

21. The toilet set of claim 1 wherein the toilet seat moves in a direction towards the toilet back portion when the toilet seat moves from the low mode to the high mode.

* * * * *